US005307943A

United States Patent [19]

Iidaka

[11] Patent Number: 5,307,943

[45] Date of Patent: May 3, 1994

[54] BOTTLE WITH ANNULAR GROOVE IN ITS NECK AND CAP

[76] Inventor: Tsuguo Iidaka, 122-2, Hinatacho, Sukagawa-shi, Fukushima-ken, Japan

[21] Appl. No.: 974,898

[22] Filed: Nov. 12, 1992

[30] Foreign Application Priority Data

Dec. 2, 1991 [JP] Japan ..... 3-106464[U]
Feb. 6, 1992 [JP] Japan ..... 4-12403[U]

[51] Int. Cl.[5] ..... B65D 1/02

[52] U.S. Cl. ..... 215/31; 215/251; 215/326

[58] Field of Search ..... 215/31, 251, 256, 258, 215/257, 326; 220/265, 267

[56] References Cited

U.S. PATENT DOCUMENTS

| | | | |
|---|---|---|---|
| 361,369 | 4/1887 | Petit | 215/257 |
| 1,742,941 | 1/1930 | Susol | 215/251 |
| 2,088,873 | 8/1937 | Sansby | 215/31 |
| 2,116,938 | 5/1938 | White | 215/257 X |
| 2,179,880 | 11/1939 | Dodge | 215/251 |
| 2,345,737 | 4/1944 | Fabrice | 215/31 X |
| 2,708,049 | 5/1955 | Sokolik | 215/31 |
| 2,863,582 | 12/1958 | Owens | 215/251 X |
| 3,080,991 | 3/1963 | Fox | 215/257 |
| 3,191,790 | 6/1965 | Coven et al. | 215/251 |
| 3,612,324 | 10/1971 | Malick | 215/31 X |
| 3,774,795 | 11/1973 | Leenaards | 215/31 X |
| 4,852,752 | 8/1989 | Ota | 215/31 |
| 4,895,265 | 1/1990 | Luch et al. | 215/31 |
| 5,012,942 | 5/1991 | Druesne et al. | 215/326 X |
| 5,119,965 | 6/1992 | Arduca et al. | 215/251 |

FOREIGN PATENT DOCUMENTS

| | | | |
|---|---|---|---|
| 234024 | 6/1964 | Austria | 215/31 |
| 898256 | 11/1953 | Fed. Rep. of Germany | 215/251 |
| 41653 | 3/1933 | France | 215/31 |
| 2256081 | 7/1975 | France | 215/31 |
| 2606372 | 5/1988 | France | 215/31 |
| 573088 | 2/1958 | Italy | 215/31 |
| 797811 | 7/1958 | United Kingdom | 215/257 |

*Primary Examiner*—Sue A. Weaver
*Attorney, Agent, or Firm*—Lorusso & Loud

[57] ABSTRACT

An annular groove is formed around the top of a wine bottle having a pouring port formed at the foremost end thereof so as to allow a liquid contained therein to be poured through the pouring port. Specifically, the annular groove is formed around the boundary corner between a flange and a head portion of the top. Alternatively, the annular groove may be formed around the boundary corner between the flange and a neck portion. Otherwise, the annular groove may be formed around the outer surface of the flange. It is preferable that the annular groove has a V-shaped sectional contour. Alternatively, the annular groove may have a U-shaped sectional contour. Otherwise, the annular groove may have a square or rectangular sectional contour. It is preferable that depth D of the annular groove be within the range of $0<D<0.6$ mm, and width B of the same be within the range of $0.3\ \text{mm} \leqq B \leqq 0.6$ mm.

9 Claims, 3 Drawing Sheets

BOTTLE WITH ANNULAR GROOVE IN ITS NECK AND CAP

BACKGROUND OF THE INVENTION

1. Field of the Invention

The present invention relates generally to a bottle such as a wine bottle or the like in which a liquid such as wine or the like is contained. More particularly, the present invention relates to a bottle of the foregoing type wherein a cylindrical cap, having a small thickness and one end closed, is fitted onto the top having a pouring port formed at the foremost end thereof so as to allow the liquid to be poured therethrough.

2. Description of the Related Art

For example, a wine bottle has a pouring port formed at its top to allow wine contained therein to be poured through the pouring port, and a cylindrical metallic cap having a small thickness (hereinafter referred to simply as a cap) is fitted around the top of the wine bottle, not only for the purpose of shielding the wine from environmental air but also for the purpose of maintaining the top in a clean state at all times for sanitary reasons. Generally, lead has been used as the metallic material for the cap because it is soft and easily expansible, and moreover, it can easily be cut by actuating a coil-shaped wine opener, a knife or a similar tool.

The cap made of lead is usually thrown away as a waste after it is removed from the top of the wine bottle. In recent years, it is increasingly and globally recognized that lead should not be used as a raw material for the cap to prevent the natural environment from being contaminated with lead, lead oxide or the like.

At present, however, no metallic material well competitive with the lead with respect to cost and physical properties is available on a commercial basis. If lead can not practically be used as a metallic raw material for the cap, it is obvious that there arises an inconvenience that any other metallic raw material employed for the cap will be inferior to the lead with respect to cost and physical properties of easy cutting and excellent pliability. When a metallic material having poor pliability is used as a raw material for the cap, cap fitting is performed at a low efficiency, and when a metallic material having a heavy thickness is employed as a starting material for the cap, material cost is unavoidably increased. Given the above circumstances, a metallic material other than lead having excellent pliability has been employed as a raw material for the cap, although it is cut with some difficulty.

In addition, it has been found that when a cap made of a metallic material other than lead having some pliability but having no possibility of contaminating the natural environment is removed or disconnected from the top of the bottle by hand, there is a danger that the hand may be injured or hurt by a sharp edge on the foremost end of the cut cap.

SUMMARY OF THE INVENTION

The present invention has been made in consideration of the foregoing background.

An object of the present invention is to provide a bottle which assures that a cap fitted around the top of the bottle can easily be removed or disconnected from the top of the bottle.

Another object of the present invention is to provide a bottle which assures that the cap can easily be cut by use of a suitable tool regardless of the kind of material employed for the cap.

According to the present invention, there is provided a bottle having a pouring port formed at the top end thereof so as to allow a liquid contained in the bottle to be poured through the pouring port and, moreover, having a flange formed for receiving a cylindrical cap. The cap is of small thickness and has one end closed and is fitted around the top so as to cover the pouring port and the flange. An annular groove is formed around the outer surface of the top of the bottle.

The annular groove is usually formed in the area between a head portion and a flange on the neck on the bottle.

Alternatively, the annular groove may be formed around the bottle in the area between a neck portion and the flange boundary corner.

The annular groove may also be formed around the outer surface of the flange.

It is preferable that the annular groove has a V-shaped cross-sectional contour.

Alternatively the annular groove may have an U-shaped cross-sectional contour.

Otherwise, the annular groove may have a square or rectangular cross-sectional contour.

It is recommended that the depth D of the annular groove be within the range defined as $0<D<0.6$ mm, while width B of the same be within the range defined as $0.3\text{ mm}\leqq B\leqq 0.6$ mm.

Other objects, features and advantages of the present invention will become apparent from a reading of the following description in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to the accompanying drawings which illustrate the preferred embodiments.

Figure 1:
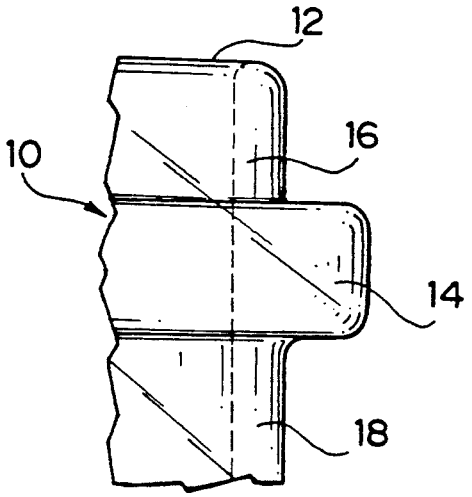
FIG. 1 is a fragmentary front view of a bottle before an annular groove is formed around its top in accordance with the present invention, particularly illustrating the contour of the top.
Figure 2:
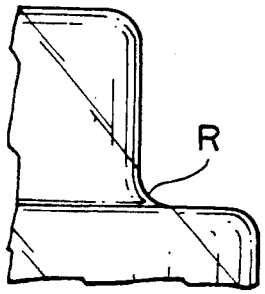
FIG. 2 (PRIOR ART)
FIG. 2 is a fragmentary front view of a conventional bottle, particularly illustrating the contour of its top including a round part around the boundary corner between a head portion and a flange.
Figure 3:
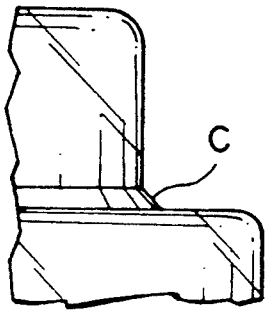
FIG. 3 (PRIOR ART)
FIG. 3 is a fragmentary front view of a conventional bottle, particularly illustrating the contour of a top including a tapered part around the boundary corner between the head portion and the flange.
Figure 5:
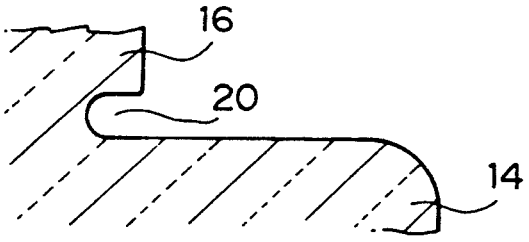
FIG. 5, is a fragmentary sectional view of a bottle, particularly illustrating an annular groove having a U-shaped sectional contour formed around the boundary corner between the head portion and the flange of the top potion, in accordance with a modification of the first embodiment of the present invention.
Figure 6:
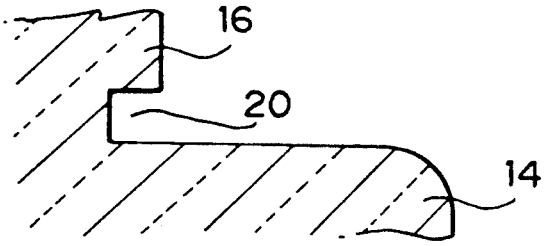
FIG. 6 is a fragmentary sectional view of the bottle, particularly illustrating an annular groove having a rectangular sectional contour formed around the boundary corner between the head portion and the flange of the top portion in accordance with another modification of the first embodiment of the present invention.

FIG. 1 is a fragmentary front view of a bottle in accordance with a first embodiment of the present invention, particularly illustrating the structure of the top of the bottle before an annular groove to be described later is formed. Cylindrical body 10 of the top of the bottle includes a pouring port 12 through which a liquid, e.g. wine, is poured, and a flange 14 having a larger diameter is formed around the outer surface of the cylindrical body 10 at a position spaced from the pouring port 12 toward a main body (not shown) of the bottle, at a distance of about 4 to 5 mm. The cylindrical region extending between the pouring port 12 and the flange 14 is hereinafter referred to as head portion 16, while the cylindrical region located opposite the head portion 16, inclusive of the latter, is hereinafter referred to as neck portion 18. The boundary corner between the head portion 16 and the flange 14 is contoured at a right angle or with a sharp edge. In this connection, it should be noted that the foregoing boundary corner is not rounded with a radius R as shown in FIG. 2 and not tapered over a length C (straight inclined surface) as shown in FIG. 3. In case that the foregoing boundary corner is tapered over the length C (straight inclined surface), it is acceptable, provided that the length C is 0.5 mm or less. This is because an annular groove 20 to be described later is formed with a sectional contour as shown in FIG. 4, FIG. 5 or FIG. 6.

Figure 4:
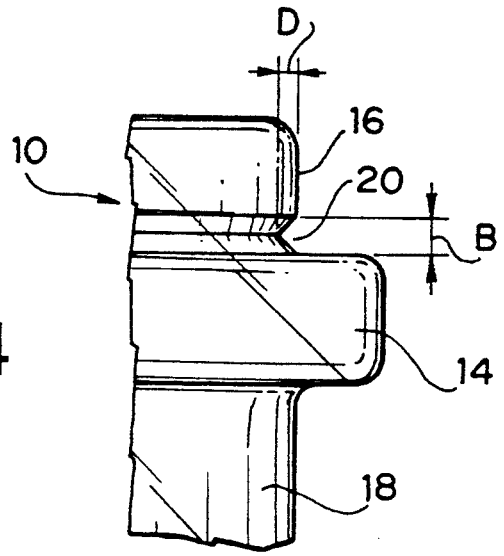
FIG. 4 is a fragmentary front view of a bottle, particularly illustrating an annular groove having a V-shaped sectional contour formed around the boundary corner, between a head portion and a flange of the top portion, in accordance with a first embodiment of the present invention.

According to the present invention, an annular groove 20 is formed around the boundary corner between the head portion 16 and the flange portion 14 (see FIG. 4). It is preferable that the annular groove 20 has a V-shaped sectional contour. Alternatively, the annular groove 20 may have an U-shaped sectional contour as shown in FIG. 5. Otherwise, it may have a square or rectangular sectional contour as shown in FIG. 6.

Figure 7:
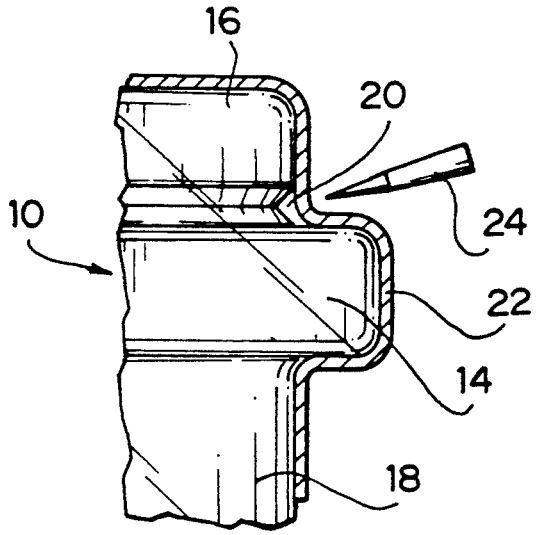
FIG. 7 is a fragmentary front view of the bottle of FIG. 4 having the V-shaped annular groove formed on the top thereof, particularly illustrating a cap having a small thickness fitted onto the top.

While the cylindrical body 10 of the tap has a contour as shown in FIG. 4, a cylindrical cap 22 having a small thickness and one closed end (hereinafter referred to simply as a cap) is fitted around the cylindrical body 10 (see FIG. 7). The whole cylindrical region of the head portion 16 and the whole cylindrical region of the flange 14 are airtightly covered with the cap 22 with its lowermost end reaching the neck portion 18. When the cap 22 is removed from the top of the bottle, a knife 24 is inserted into space 26 from the outside by the user and thereafter, it is moved in a circle around the annular groove 20 to cut the cap 22 along the groove 20. Since the annular groove 22 has a predetermined depth so that when the knife 24 reaches the bottom of the annular groove 20, the cap 22 is cut along the annular groove 20 without fail. Although the annular groove 22 cannot be seen by the user from the outside because it is covered with the cap 22, the knife 24 can properly be introduced into the annular groove :22, since the latter is located adjacent the upper side wall of the flange 14.

On completion of the cutting of the cap 22, the upper remaining part of the cap 22 has a (cylindrical contour with one end closed. Thus, it can easily be removed from the top of the bottle by hand.

It is preferable that depth D of the annular groove 20 be within the range defined as $0<D<0.60$ mm. It is most preferable that it be within the range of $0.3 \leqq D \leqq 0.5$ mm. If it exceeds 0.6 mm, the foremost end circular edge of the cut cap 22 will fold into close contact with the inclined wall surface of the annular groove 20 and, as a result, that part of the cap 22 remaining on the head portion 16 side can be removed from the annular groove 20 only with difficulty. In addition,, when the depth of the annular groove 20 is excessively large, there arises the problem that the strength of the bottle as measured at the position around the annular groove 20 is reduced.

On the other hand, it is preferable that the width B of the annular groove 20 be within the range of 0.3 mm $\leqq B \leqq$ 0.6 mm. If it is smaller than 0.3 mm, it becomes difficult to position the knife 24 in correct alignment with the annular groove 22. In other words, it becomes difficult to visually recognize the annular groove 20. On the contrary, if it is larger than 0.6 mm, the foremost end annular edge of the cut cap 22 is likewise folded into close contact with the inclined wall surface of the annular groove 20 and, as a result, that part of the cap 22 remaining on the head portion 16 side of the bottle can be removed from the annular groove 20 only with difficulty.

As is apparent from the above description, the formation of the annular groove 20 around the boundary corner between the flange 14 and the head portion 16 makes it possible to easily cut the cap 22 with the aid of the knife 24 by introducing the latter into the annular groove 20. In addition, the part of the cap 22 remaining on the head portion 16 side after completion of the cutting operation can easily be removed from the annular groove 20 by hand. Since the cap is smoothly cut straight along the annular groove 20, use of a material harder than lead as a material for the cap 22 poses no particular problem.

Figure 9:
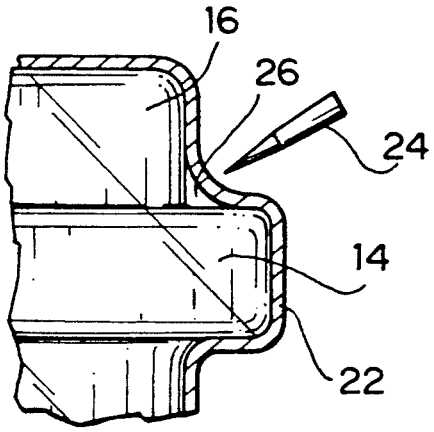
FIG. 9 (PRIOR ART)
FIG. 9 is a fragmentary front view of the conventional bottle of FIG. 3, particularly illustrating a cap having a small thickness fitted onto the top of the drinking bottle.

In contrast to the structure of a conventional bottle as shown in FIG. 9, wherein a portion of, for example, wine drips down onto the main body of the drinking bottle below the flange and onto the neck portion as the wine is poured by tilting the bottle, the bottle of the present invention prevents the dripping wine from reaching the main body because it is collected in the annular groove 20.

Next, a bottle in accordance with a second embodiment of the present invention will be described below with reference to FIG. 8.

Figure 8:
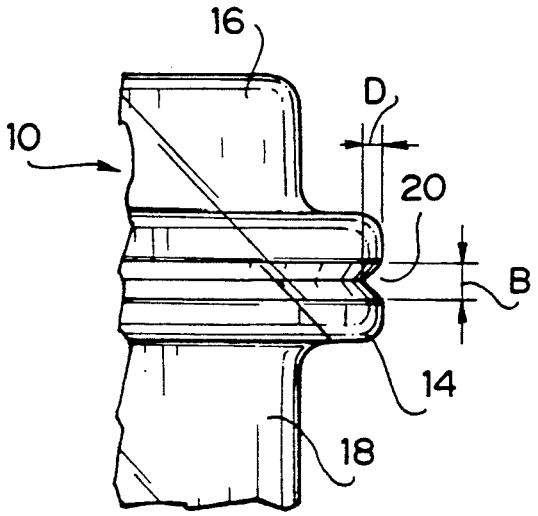
FIG. 8 is a front view of a bottle, particularly illustrating an annular groove having a V-shaped sectional contour formed around the flange of the top in a second embodiment of the present invention.

FIG. 8 is a fragmentary front view of the bottle, particularly illustrating the structure of the top portion of the bottle. Those features shared in common with FIGS. 1 to 7 are represented by the same reference numerals.

An annular groove 20 is formed around the outer peripheral surface of a flange 14, in contrast to the bottle of the first embodiment of the present invention wherein the annular groove 20 is formed around the boundary corner between the flange 14 and the head portion 16. Since the flange 14 has a heavy thickness and a high strength compared with the head portion 16 and the neck portion 18, there is little possibility that it will be damaged or broken when the annular groove 20 is formed in the flange 14. Consequently, the bottle can be produced at an improved yield.

Also in this embodiment, it is preferable that depth D of the annular groove 20 be within the range of $0<D<0.6$ mm and that width B be within the range of $0.3\ \text{mm} \leqq B \leqq 0.6$ mm.

It is readily recognized by any expert in that art that hollow space 26 is formed on the conventional bottle so as to allow knife 24 to be forcibly introduced into the hollow space 26 for the same cutting purpose as the annular groove 20 on the cylindrical body 10 of the bottle proposed in accordance with the first embodiment of the present invention. Specifically, the area (boundary corner) between the head portion 16 and the flange 14 is spaced away from the cap 22 without any close contact with the cap 26. It is obvious that the cap 22 can easily be cut by use of knife 24 by hand by penetration of the knife into the hollow space 26. However, cutting a cap utilizing the hollow space in the above-described manner has drawbacks that there is a possibility that the hollow space 26 cannot reliably be penetrated by the knife 24, and moreover, the edges of the cut cap 24 become ragged.

In the aforementioned first embodiment, the annular groove 20 is formed around the boundary corner between the flange 14 and the head portion 16. Alternatively, the annular groove 20 may be formed around the boundary corner between the flange 14 and the neck portion 18. Also in this case, depth D of the annular groove 20 and width B of the same are determined in the same manner as for first embodiment of the present invention.

As described above, the present invention provides a bottle which assures that a cap having a small thickness can easily be cut without any danger of injury to the user's hand. Thus, a material other than lead can be employed as a raw material for the bottle cap even when the material has a hardness higher than that of lead. Further, since the annular groove serves to collect liquid dripping from the pouring port of the top of the bottle, the dripping liquid cannot reach the main body of the bottle.

While the present invention has been described above with respect to a few preferred embodiments thereof, it should of course be understood that the present invention should not be limited only to these embodiments but, rather, that various changes or modifications may be made without departure from the scope of the present invention as defined by the appended claims.

What is claimed is:

1. A wine bottle and cap combination including:

a top portion and a body portion, said top portion having a pouring spout to allow a liquid contained in the bottle to be poured out of the bottle, said top portion further having a circumferential flange and an annular groove, said flange dividing said top portion into a neck portion and a head portion; and a cylindrical cap, having one end closed, fitted to and in intimate contact with said top portion, including said head portion and said flange so as to cover said pouring spout and bridging, without entering, said annular groove to define an annular cavity, in co-operation with said annular groove, said cylindrical cap forming an airtight seal with said flange and being of a material and a thickness allowing it to be readily manually cut through and linearly around its surface with a knife, whereby the knife can pierce through said cap and enter said annular cavity for cutting said cap.

2. A wine bottle according to claim 1 wherein said head portion had an enlarged head member surrounding said pouring spout and wherein said annular groove is formed around the head portion between said flange and said head member.

3. A wine bottle according to claim 1 wherein said annular groove is formed around a junction between said flange and said neck portion.

4. A wine bottle according to claim 1 wherein said annular groove is formed around the peripheral surface of said flange.

5. A wine bottle according to claim 4 wherein said annular groove has a V-shaped cross-sectional contour.

6. A wine bottle according to claim 4 wherein said annular groove has a U-shaped cross-sectional contour.

7. A wine bottle according to claim 4 wherein said annular groove has a square or rectangular cross-sectional contour.

8. A wine bottle according to claim 1 wherein the depth D of said annular groove is within the range of $0<D<0.6$ mm.

9. A wine bottle according to claim 1 wherein the width B of said annular groove is within the range of $0.3\ \text{mm} \leqq B \leqq 0.6$ mm.

* * * * *